US006953385B2

(12) United States Patent
Singh, Jr.

(10) Patent No.: US 6,953,385 B2
(45) Date of Patent: Oct. 11, 2005

(54) SYSTEM, METHOD, AND APPARATUS FOR NON-TRADITIONAL KINEMATICS/TOOLING FOR EFFICIENT CHARGING OF LAPPING PLATES

(75) Inventor: Albert Enrique Singh, Jr., Hollister, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 10/773,078

(22) Filed: Feb. 5, 2004

(65) Prior Publication Data

US 2005/0176351 A1 Aug. 11, 2005

(51) Int. Cl.[7] ..... B24B 1/00
(52) U.S. Cl. ..... 451/28; 451/56
(58) Field of Search ..... 451/28, 56

(56) References Cited

U.S. PATENT DOCUMENTS 4,104,099 A * 8/1978 Scherrer ..... 156/155
4,165,584 A * 8/1979 Scherrer ..... 451/289
4,866,886 A * 9/1989 Holmstrand ..... 51/307
5,695,387 A * 12/1997 Moravec et al. ..... 451/56
6,585,559 B1 * 7/2003 Griffin et al. ..... 451/5
6,602,108 B2 * 8/2003 Griffin et al. ..... 451/5
6,802,761 B1 * 10/2004 Beaucage et al. ..... 451/28

FOREIGN PATENT DOCUMENTS

JP 2001232558 A * 8/2001 ..... B24B 37/00

* cited by examiner

*Primary Examiner*—David B. Thomas
(74) *Attorney, Agent, or Firm*—Bracewell & Giuliani LLP

(57) ABSTRACT

A system for charging lapping plates incorporates the use of individual ceramic inserts that are mounted into a stainless steel frame to form a novel charging tool. The charging tool is rotated clockwise against a counterclockwise rotating tin plate. This configuration performs a rapid diamond impregnation into the plate without scraping off the diamond slurry from the plate. This design uses the diamond material in the plate charging slurry very efficiently. The inserts may be formed from high density ceramic in a round or cylindrical pad-like design. This design allows high pressure contact between the inserts and the tin plate. As a result, the amount of time required to charge a plate is greatly reduced and only a small fraction of the diamond slurry is wasted, thereby producing a higher yield than prior art systems.

8 Claims, 2 Drawing Sheets

SYSTEM, METHOD, AND APPARATUS FOR NON-TRADITIONAL KINEMATICS/TOOLING FOR EFFICIENT CHARGING OF LAPPING PLATES

BACKGROUND OF THE INVENTION

1. Technical Field

The present invention relates in general to improved lapping plate charging and, in particular, to an improved system, method, and apparatus for non-traditional kinematics/tooling for efficient diamond charging of lapping plates.

2. Description of the Related Art

Magnetic recording is employed for large memory capacity requirements in high-speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface (ABS). Large numbers of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The slider head is typically an inductive electromagnetic device including magnetic pole pieces, which read the data from or write the data onto the recording media surface. In other applications the magnetic head may include a magneto-resistive read element for separately reading the recorded data with the inductive heads serving only to write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. Each head has a polished ABS with flatness parameters, such as crown, camber, and twist. The ABS allows the head to "fly" above the surface of its respective spinning disk. During manufacturing, it is most critical to grind or lap these elements to very close tolerances of desired flatness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider ABS.

Rotating lapping plates having horizontal lapping surfaces in which abrasive particles such as diamond fragments are embedded have been used for lapping and polishing purposes in the high precision lapping of magnetic transducing heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature normal to the surface is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

Current traditional methods used industry wide for diamond charging of lapping plates are very inefficient. Typically, less than 10% of the diamond used in the process is actually retained by the lapping plates for use during the process of final lapping of the air bearing surface (ABS) of magnetic recording head sliders. Long cycle times and large amounts of wasted diamond material make these diamond charging processes very expensive. For example, the diamond material can cost millions of dollars each year. Unfortunately, because of the inefficiencies of current systems, approximately 90% of the diamond material is lost and unrecoverable in the process.

Typical diamond charging processes utilize a ceramic alumina ring (i.e., a charging tool) that is mounted on a tin lapping plate. Both the ring and the plate are rotated in counter-clockwise directions while the diamond slurry is applied to the plate surface. The downward force of the ceramic ring impregnates the diamond particles into the softer tin surface. The drawbacks of this process are that the centrifugal forces involved and the scraping action of the ceramic ring allow for most of the diamond slurry to be removed from the plate surface before it has a chance to deliver diamond to the lap plate surface. Thus, an improved system, method, and apparatus for charging lapping plates would be desirable.

SUMMARY OF THE INVENTION

One embodiment of a system, method, and apparatus for diamond charging of lapping plates incorporates the use of individual ceramic inserts that are mounted into a stainless steel frame to form a novel charging tool. The charging tool is rotated clockwise, rather than counterclockwise, against the counterclockwise rotating tin plate. This configuration performs a much faster diamond impregnation into the plate without scraping off the diamond slurry from the plate. This design uses the diamond material in the plate charging slurry more efficiently than prior art methods.

The inserts may be formed from high density ceramic in a round or cylindrical pad-like design. This design allows for higher pressure contact between the inserts and the tin plate than conventional methods. As a result, the amount of time required to charge a plate is greatly reduced and only a small fraction of the diamond slurry is wasted, thereby producing a higher yield than prior art systems.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
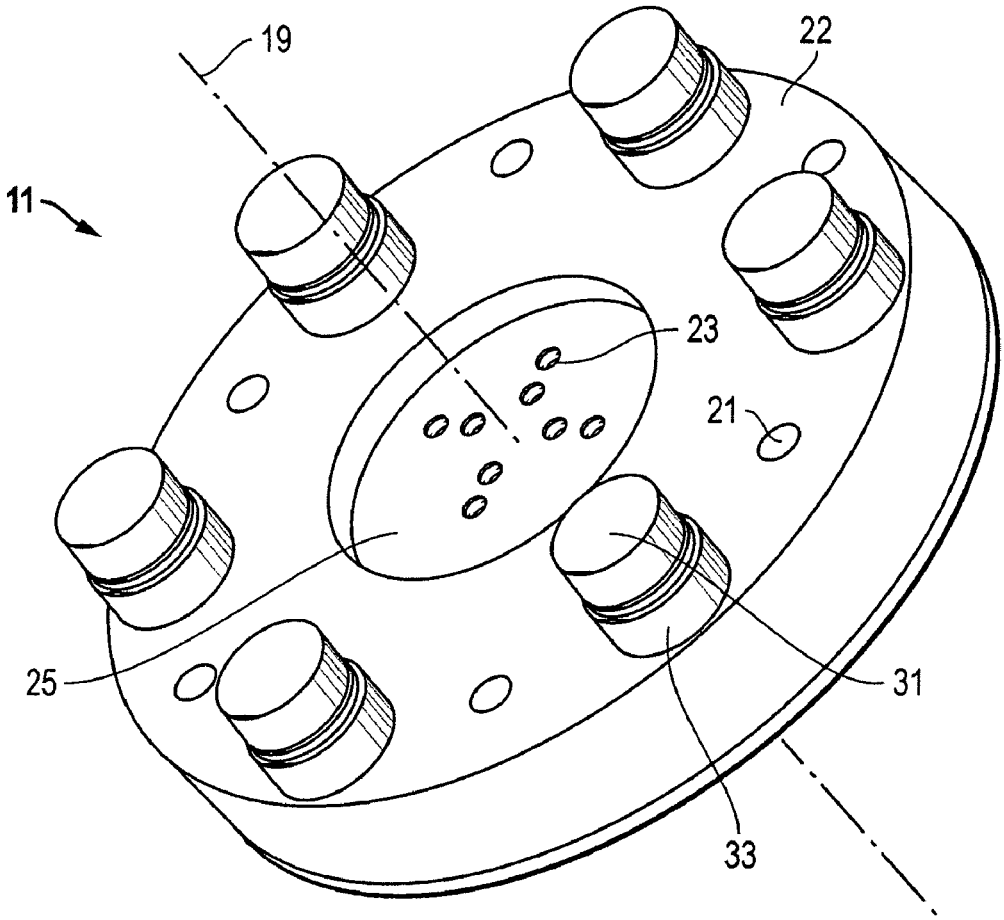
FIG. 1 is a lower isometric view of one embodiment of a fixture for charging a lapping plate is shown and is constructed in accordance with the present invention.
Figure 2:
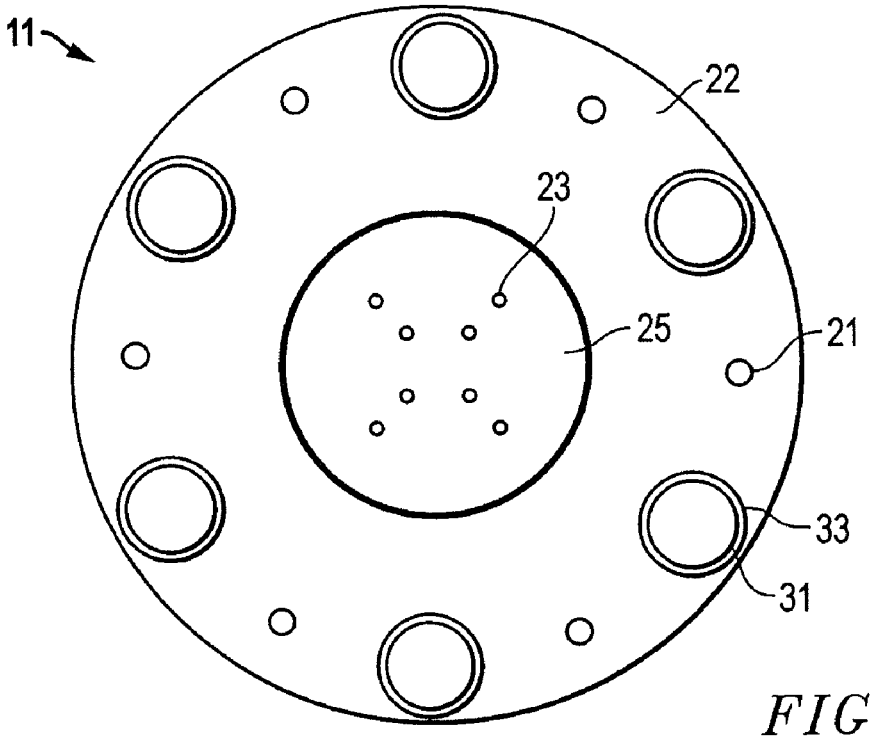
FIG. 2 is a bottom view of the fixture of FIG. 1.

Referring to FIGS. 1 and 2, one embodiment of a fixture 11 for charging a lapping plate is shown. The fixture 11 comprises a portion of a charging tool 13 (FIG. 3) that uses an abrasive (e.g., diamond) when a slurry 15 containing the abrasive is introduced between the charging tool 13 and the lapping plate 17. In the embodiment shown, the fixture 11 has a circular, plate-like shape, a rotational axis 19, and is preferably formed from stainless steel. The fixture 11 also has a plurality of apertures 21 (six shown) in its lower surface 22, and a set of mounting holes 23 located in a recess 25 for engaging drive means 27 for rotating the fixture 11 about rotational axis 19. Both apertures 21 and mounting holes 23 are axially symmetric, and the recess 25 comprises a centrally located, cylindrical depression in the embodiment of FIGS. 1 and 2.

Fixture 11 also comprises a plurality (six shown) of discrete, discontinuous charging elements 31 that are removably mounted thereto. In the embodiment shown, charging elements 31 are mounted to rigid mounting features 33, such as cups, which contain machined threads for receiving and engaging threads that are formed on the removable charging elements 31. The charging elements 31 are generally cylindrical in shape (other shapes are also available) and are symmetrically spaced-apart from each other about the rotational axis 19 of the fixture 11. The charging elements 31 are formed from a high-density ceramic, such as 99.5% purity. Each of the charging elements 31 has a generally round facing surface for applying pressure to and embedding abrasive 15 into the lapping plate 17 (FIG. 3).

Figure 3:
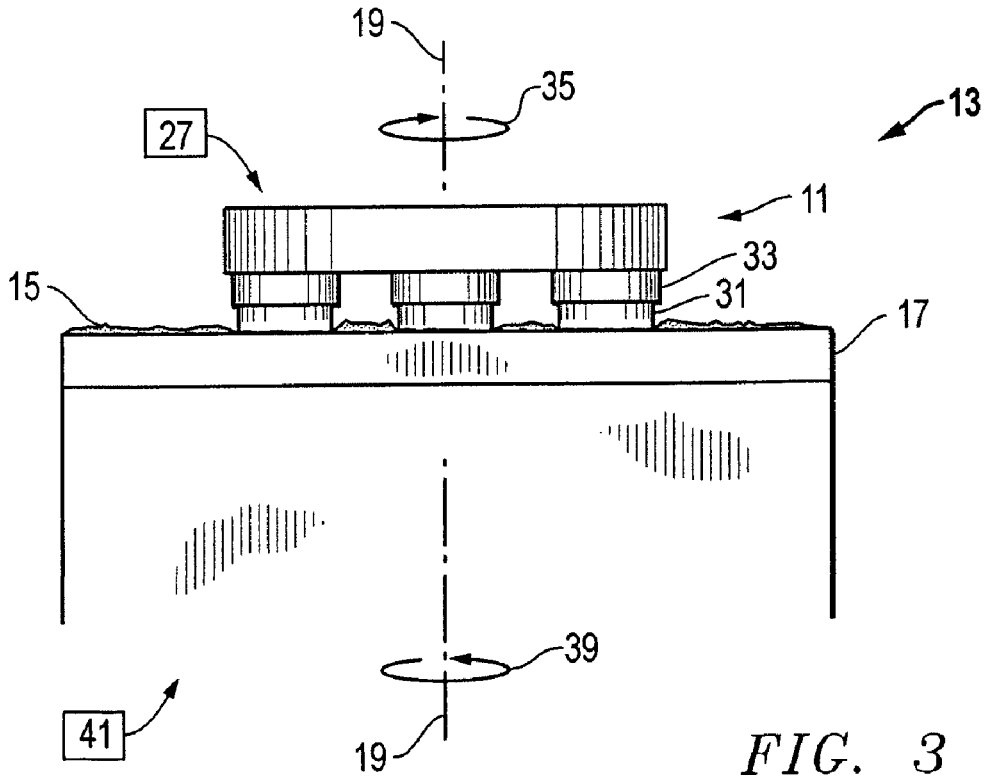
FIG. 3 is a side view of the fixture of FIG. 1 in operation.

As shown in FIG. 3, the fixture 11 and lapping plate 17 are axially aligned. The charging tool 13 rotates the fixture 11 in a rotational direction 35 that is opposite to a rotational direction 37 of the lapping plate 17. Ideally, the fixture 11 is rotated by drive means 27 in a clockwise direction, while the lapping plate 17, which is located on a pedestal 39 or other support means, is rotated in a counterclockwise direction by drive means 41.

In operation, the present invention comprises a system for charging a lapping plate 17. One embodiment of the system comprises the lapping plate 17, the charging tool 13 having the fixture 11 with a plurality of the discrete charging elements 31 mounted thereto, and the abrasive slurry 15. As described above, the fixture 11 is rotated in one direction 35 and the lapping plate 17 is rotated in an opposite direction 39. This process charges the lapping plate 17 with the abrasive by embedding the abrasive into the lapping plate 17 when the slurry 15 is introduced between the fixture 11 and the lapping plate 17.

Because of the design improvements of the present invention, the system is able to operate at a higher pressure between the fixture 11 and the lapping plate 17 than that used in conventional charging systems. For example, in one embodiment, the system operates in a pressure range between approximately 10 and 30 psi. In addition, these improvements allow the system to completely charge the lapping plate in only approximately 30 to 45 minutes. Furthermore, the system of the present invention utilizes far less abrasive slurry (only about 10% of what is normally required) than conventional systems. The slurry is scraped off the lapping plate 17 at a rate of approximately 5 ml/min (milliliters per minute), which yields a much higher production at a much lower cost.

The present invention also comprises a method of charging a lapping plate. One embodiment of the method comprises providing a lapping plate 17 and a charging tool 13 having a fixture 11 with a plurality of charging elements 31; introducing a slurry 15 containing an abrasive between the lapping plate 17 and the charging elements 31; rotating the fixture 11 in one direction 35 and the lapping plate 17 in an opposite direction 39; and charging the lapping plate 17 with the abrasive by embedding the abrasive into the lapping plate 17 with the charging elements 31. The method may further comprise forming the charging elements 31 in a cylindrical shape, forming the charging elements 31 from a high density ceramic, symmetrically spacing the charging elements 31 on the fixture 11 about a rotational axis 19 of the fixture 11, and/or forming the fixture 11 from stainless steel.

In addition, the method may comprises rotating the fixture 11 in a clockwise direction and rotating the lapping plate 17 in a counter-clockwise direction; applying a pressure between the charging elements 31 and the lapping plate 17 in a range of approximately 10 to 30 psi; completely charging the lapping plate 17 in approximately 30 to 45 minutes; and/or scraping the slurry 15 off of the lapping plate at a rate of approximately 5 ml/min, such that only about 10% of the previously-required amount of slurry 15 is used (i.e., compared to conventional systems).

The present invention has several advantages. By utilizing very simple mechanical concepts and inexpensive tooling designs, the present invention reduces material usage, waste, and process cycle times, for a significant cost savings. The enhanced design of the present invention allows the system to operate at higher-than-normal pressures, which facilitate a complete lapping plate charge in a fraction of the time normally required by convention systems. The present invention also uses a fraction of the abrasive slurry required by conventional systems.

While the invention has been shown or described in only some of its forms, it should be apparent to those skilled in the art that it is not so limited, but is susceptible to various changes without departing from the scope of the invention.

What is claimed is:

1. A method of charging a lapping plate, comprising:

(a) providing a lapping plate and a charging tool having a fixture with a plurality of charging elements, and forming the charging elements from a high density ceramic;

(b) introducing a slurry containing an abrasive between the lapping plate and the charging elements;

(c) rotating the fixture in one direction and the lapping plate in an opposite direction;

(d) charging the lapping plate with the abrasive by embedding the abrasive into the lapping plate with the charging elements.

2. The method of claim 1, further comprising symmetrically spacing the charging elements on the fixture about a rotational axis of the fixture.

3. The method of claim 1, further comprising forming the fixture from stainless steel.

4. The method of claim 1, wherein step (c) comprises rotating the fixture in a clockwise direction and rotating the lapping plate in a counter-clockwise direction.

5. The method of claim 1, further comprising completely charging the lapping plate in approximately 30 to 45 minutes.

6. The method of claim 1, further comprising scraping the slurry off of the lapping plate at a rate of approximately 5 ml/min.

7. A method of charging a lapping plate, comprising:

(a) providing a lapping place and a charging tool having a fixture with a plurality of charging elements, and forming the charging elements in a cylindrical shape;

(b) introducing a slurry containing an abrasive between the lapping plate and the charging elements;

(c) rotating the fixture in one direction and the lapping plate in an opposite direction;

(d) charging the lapping plate with the abrasive by embedding the abrasive into the lapping plate with the charging elements.

8. A method of charging a lapping plate, comprising:

(a) providing a lapping plate and a charging tool having a fixture with a plurality of charging elements;

(b) introducing a slurry containing an abrasive between the lapping plate and the charging elements;

(c) rotating the fixture in one direction and the lapping plate in an opposite direction;

(d) charging the lapping plate with the abrasive by embedding the abrasive into the lapping plate with the charging, elements; and applying a pressure between the charging elements and the lapping plate in a range of approximately 10 to 30 psi.

* * * * *